United States Patent [19]

Reavis, Jr. et al.

[11] 4,343,529

[45] Aug. 10, 1982

[54] TERMINAL BLOCK WITH SELF LOCKING TERMINAL

[75] Inventors: Robert P. Reavis, Jr., Stateville; Lawrence P. Weisenburger, Winston-Salem, both of N.C.

[73] Assignee: AMP Incorporated, Harrisburg, Pa.

[21] Appl. No.: 160,886

[22] Filed: Jun. 19, 1980

[51] Int. Cl.[3] ..... H01R 9/16

[52] U.S. Cl. ..... 339/198 R; 29/884; 339/97 R

[58] Field of Search ..... 339/198, 97 R, 97 P, 339/98; 29/876, 882, 884

[56] References Cited

U.S. PATENT DOCUMENTS

| | | | |
|---|---|---|---|
| 2,478,143 | 8/1949 | Watts | 173/324 |
| 2,909,756 | 10/1959 | Sitz | 339/198 |
| 3,732,522 | 5/1973 | Hartwell et al. | 339/198 R X |
| 4,195,194 | 3/1980 | Kuster et al. | 339/198 R X |
| 4,210,379 | 7/1980 | Vachhani et al. | 339/101 |
| 4,236,778 | 12/1980 | Hughes et al. | 339/198 H X |

OTHER PUBLICATIONS

"Terminal Boards", Kulka Electric Corp. Catalog 17C, 1978, pp. 9, 25, 29, 33, 37, 41, 45, 53, 55, 59, 61, 63.

*Primary Examiner*—Eugene F. Desmond
*Attorney, Agent, or Firm*—Gerald K. Kita

[57] ABSTRACT

The disclosure relates to an improved terminal block in which each terminal is barrel shaped with a flared skirt, which locks the terminal from movement in one direction, and a plate portion of the terminal is bent over to lock the terminal from movement in an opposite direction. The plate cooperates with projecting ears of the terminal to prevent rotation.

5 Claims, 8 Drawing Figures

Fig. 5
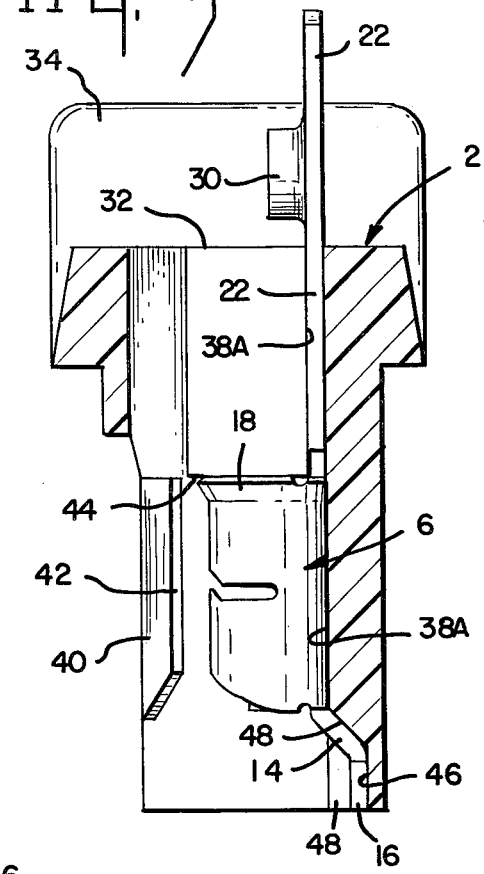
Fig. 6
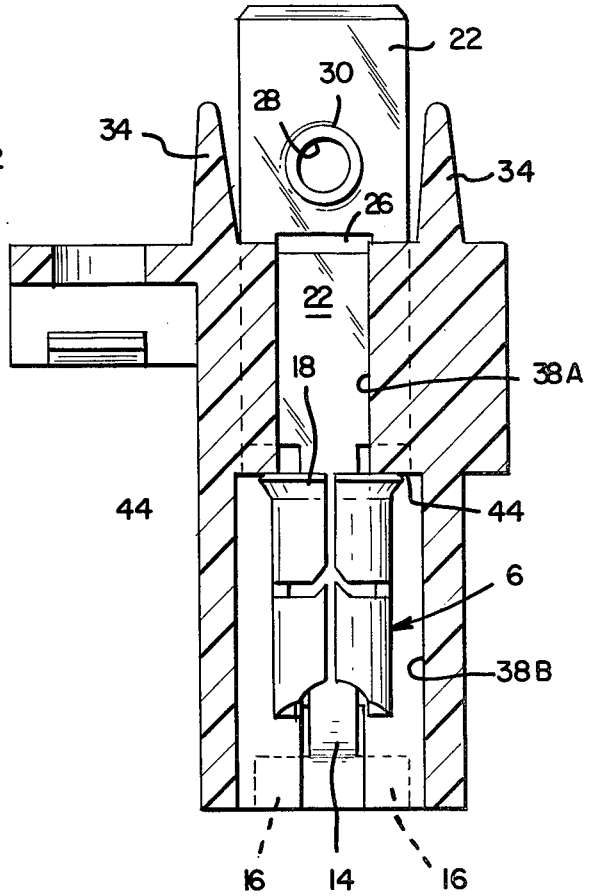
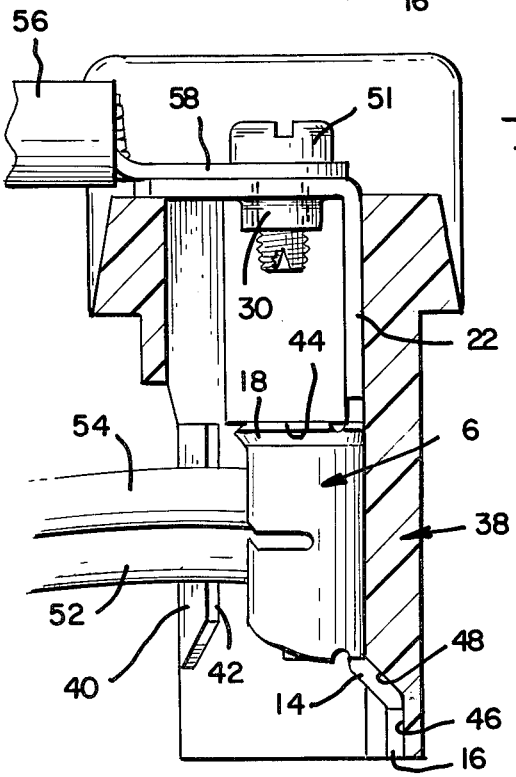
Fig. 7
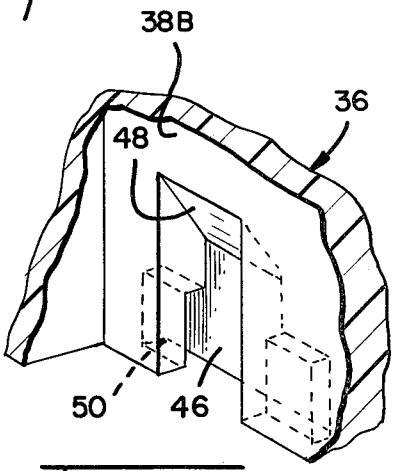
Fig. 8

TERMINAL BLOCK WITH SELF LOCKING TERMINAL

CROSS REFERENCE TO RELATED APPLICATION

This application is related to pending application, Ser. No. 06/061,722 filed July 30, 1979.

FIELD OF THE INVENTION

The invention relates to an improved terminal block and an assembly method for installing electrical terminals in a terminal block housing.

BACKGROUND OF THE PRIOR ART

A terminal block, disclosed in U.S. Pat. No. 2,909,756, includes a molded dielectric base assembled with electrical terminals. Electrical wire conductors are wrapped around the shanks of screws which are threadably secured to the terminals. Alternatively, the wire conductors are first connected to electrical contacts which are then secured to the terminals by screws.

SUMMARY OF THE INVENTION

The invention relates to a terminal block in which each of plural terminals is in the form of a barrel shape, divided into tandem sets of wire gripping jaws. Details of such jaws are disclosed in U.S. Pat. No. 4,141,618.

Each terminal of the present invention is assembled to the housing by passing a plate of the terminal along a narrow passageway in the housing, and then by bending over a portion of the plate which has emerged from the passageway. The bent over plate locks the terminal from movement along the passageway in one direction. A flared lip or skirt of the terminal seats against a shoulder of the housing to lock the terminal from movement in a second direction, opposite the first direction. The skirt also supports the terminal during wire insertion. The plate and projecting ears on each terminal lock the terminal from rotation relative to the housing.

An object of the present invention is to provide a method for assembling a barrel shaped terminal to a terminal block housing, and for preventing rotation and other movement of the terminal relative to the housing.

Another object is to provide a terminal block in which each terminal is assembled to a housing and locked from rotation and axial movement.

Other objects and advantages of the present invention will become apparent from the following detailed description taken in conjunction with the drawings.

DESCRIPTION OF THE DRAWINGS

FIGS. 3, 4, 5, and 6 are enlarged sections through a terminal receiving passageway of the aforementioned housing, illustrating the various steps of terminal assembly in the passageway.

FIG. 7 is a section similar to FIG. 5, illustrating termination of wire conductors to a terminal.

FIG. 8 is an enlarged fragmentary perspective of a portion of the housing, illustrating an antirotational feature.

DETAILED DESCRIPTION

Figure 1:
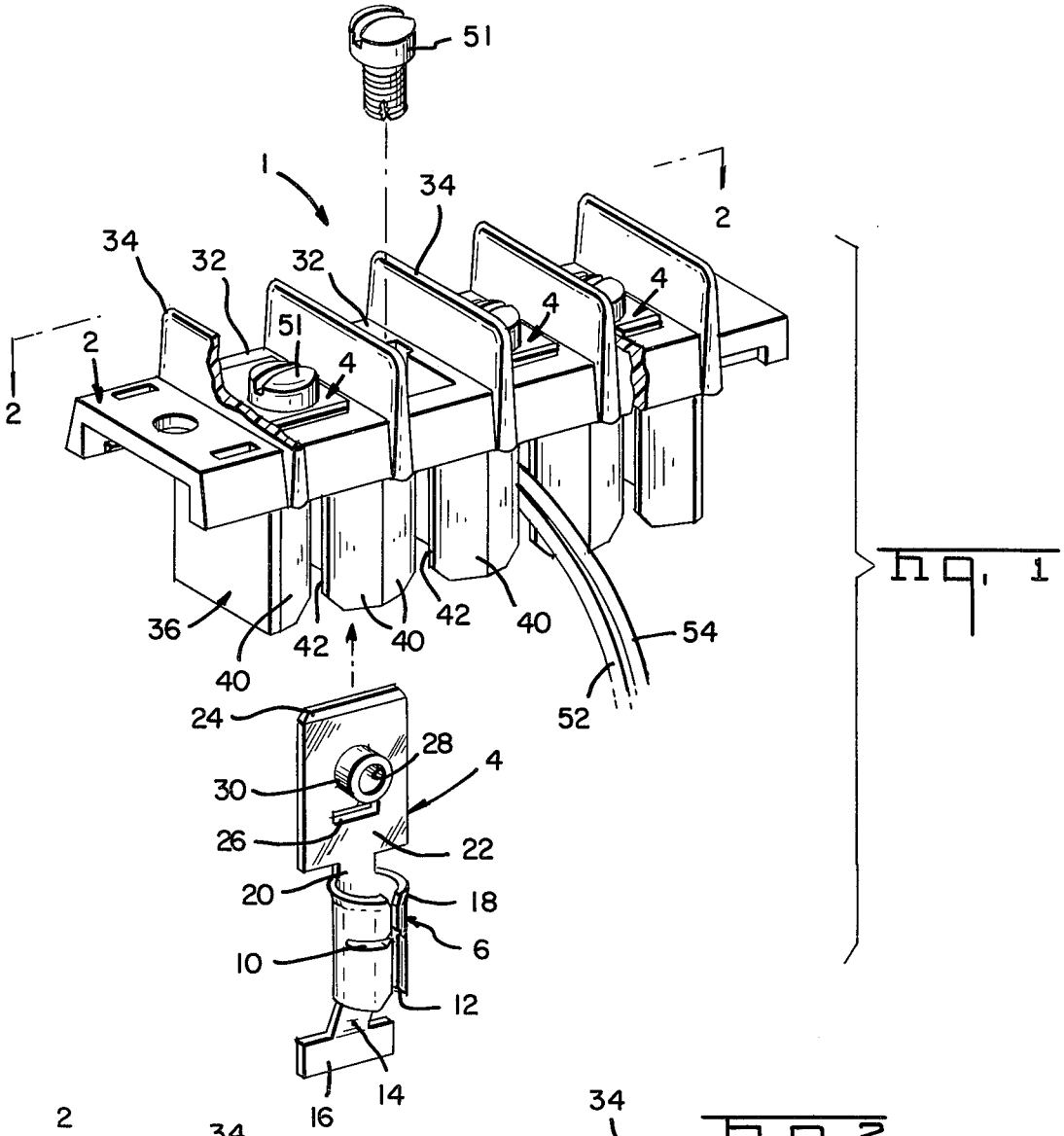
FIG. 1 is a perspective of a terminal block, according to a preferred embodiment, with a terminal shown exploded and in a form prior to assembly or installation in a housing of the terminal block.
Figure 4:
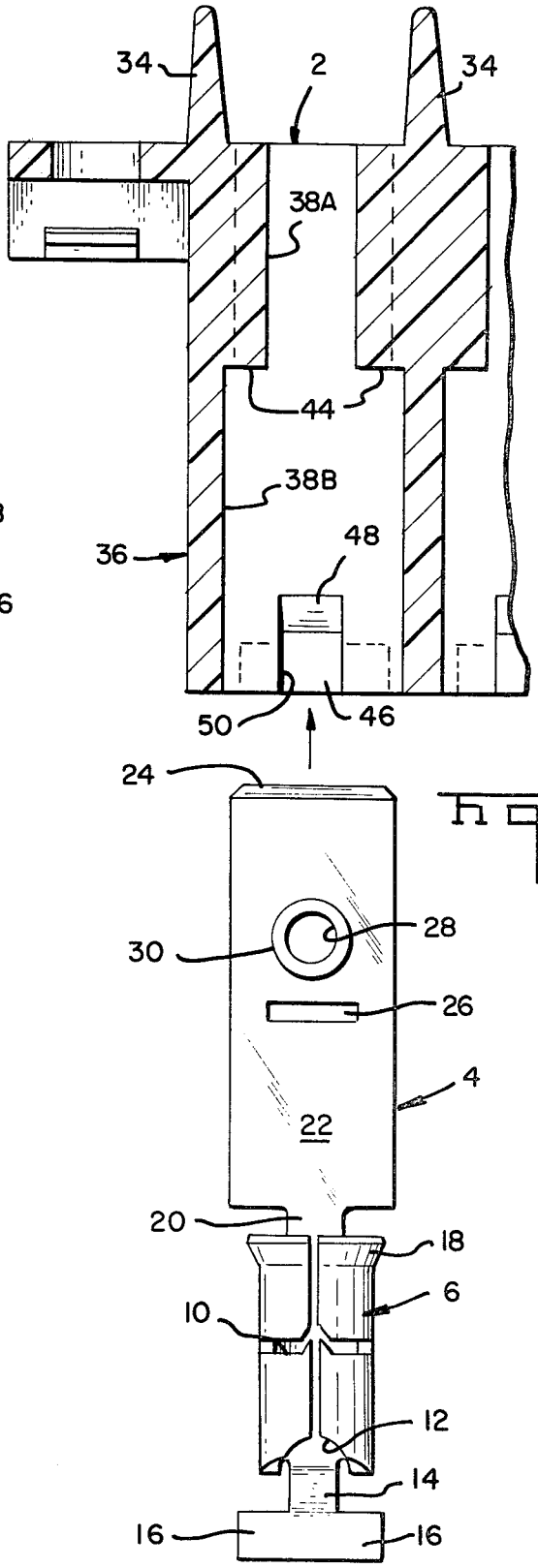

With more particular reference to FIG. 1, there is shown generally at 1 a terminal block, comprising a molded dielectric housing 2 and a plurality of metal electrical terminals 4. One of the terminals is shown more specifically in FIG. 4, stamped and formed from a single metal blank. A portion of the terminal is rolled about a longitudinal axis into a hollow sleeve or barrel 6 having an axially extending open seam 8 opening into each open end of the barrel. The seam is intersected by an axially transverse slot 10 which divides the seam into tandem sets of resilient, wire engaging jaws, which are on opposite sides of the seam, and which grip opposite sides of a respective wire conductor forcibly inserted in and along the seam. One end of the barrel includes a flared entry 12 to funnel a wire conductor into one end of the seam 8. The same end of the terminal includes an integral stem 14, which is bent to incline relative to the axis of said barrel, and which has a T-shaped end defining oppositely directed ears 16 in a common plane that is parallel axially of the terminal.

The opposite end of the barrel 6 is formed with a radially outward flared lip or skirt 18 and an integral, axially extending stem 20. It is necessary that the stems 14 and 20 be of narrow width where they join the barrel 6 in order not to stiffen the barrel or to cause substantial change in the resilient spring characteristics of the wire gripping jaws. Integral with the stem 20 is a portion in the form of a planar plate 22, of wider width than the stem 20. The plate free end 24 has chamfered edges to facilitate insertion into the housing 2, in a manner to be described. The plate also has an axially transverse slit 26 which weakens the plate and allows bending of the plate sharply along a line, the direction of which is defined along the length of the slit. The plate also includes a screw receiving opening 28 encircled by a lip 30 which is formed by deforming metal material to project out of the plane of the plate 22.

Figure 2:
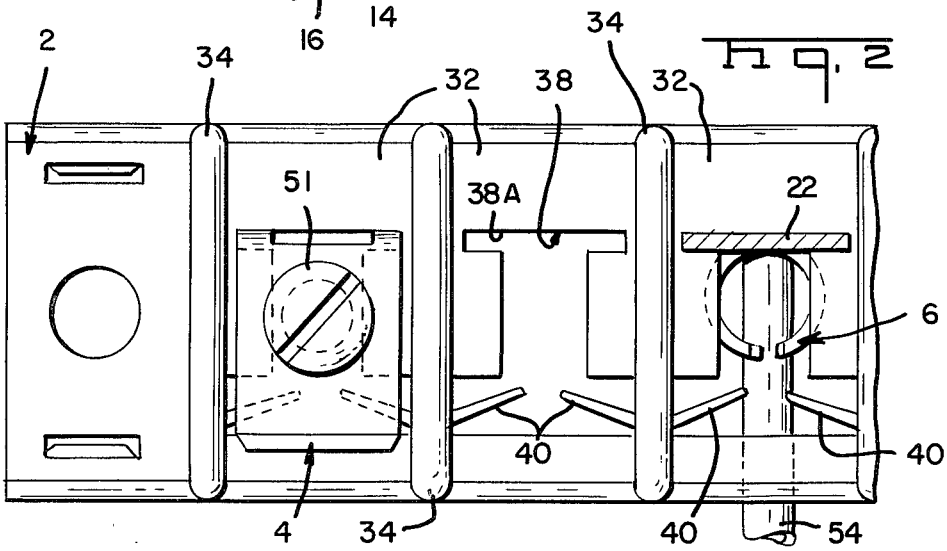
FIG. 2 is a fragmentary plan view of the terminal block shown in FIG. 1.
Figure 3:
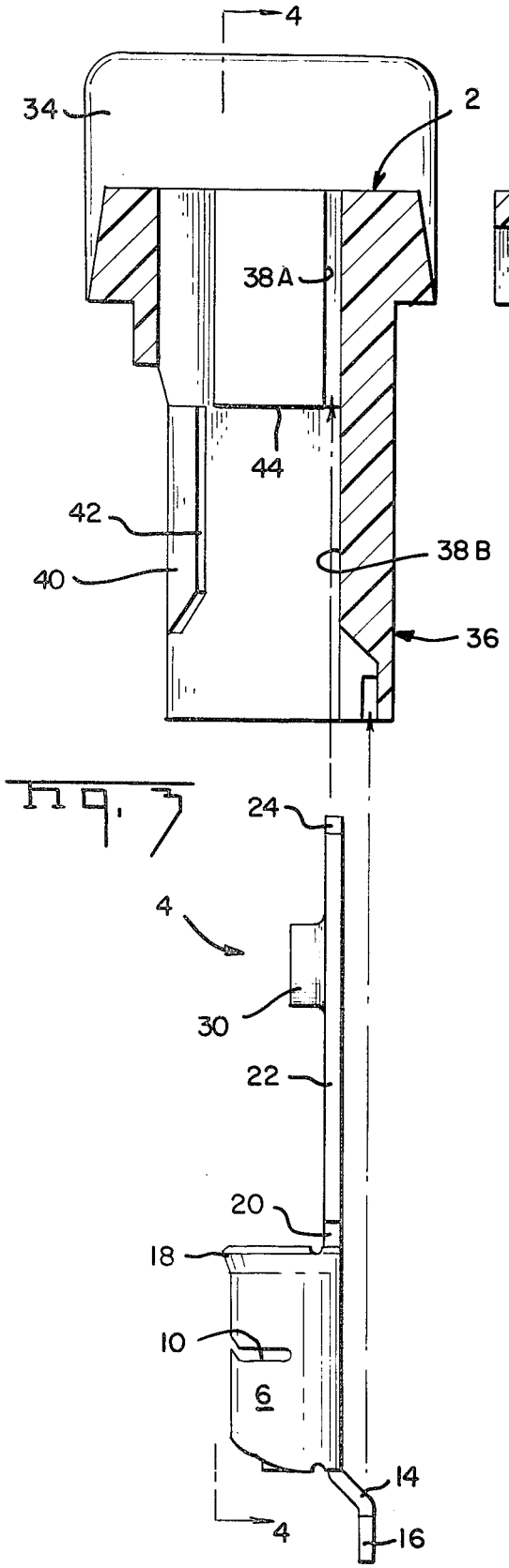

FIGS. 1 and 2 illustrate the housing 2 molded with a platform 32 and integral partitions 34, distributed along the platform and separating adjacent terminals 4 from one another. The housing has a section 36 depending from the platform and provided with stepped passageways 38, each communicating with the platform and in between adjacent partitions. FIGS. 2–6 show that each passageway includes a passageway section 38A, with a T-shaped cross section communicating with the platform 32. An inverted pair of shoulders 44 is defined at the junction of passageway section 38A and another, enlarged passageway section 38B, communicating with the bottom end of the housing section 36. A pair of flanges 40 are integral with the housing and are separated by a slot 42, open at its end and communicating along its length with passageway section 38B.

FIG. 8 shows an inverted T-shaped recess 46 communicating with the bottom end of the housing section 36. The bottom wall 48 of the recess 46 is inclined, and also serves as the common bottom wall for an open end slot 50 which communicates with the recess 46 and which is of narrower width than the recess 46.

A terminal 4 is assembled in each recess 38, with FIGS. 3–6 illustrating installation of one of the terminals. The unbent plate 22 is inserted first into the recess section 38B and serially along the recess section 38A. The chamfered end prevents stubbing during insertion. Insertion is complete when the skirt 18 stops against the shoulders 44, and the inclined stem 14 seats or stops against the complementary inclined end wall 48, and the ears 16 interfit with the complementary shaped recess 46. The skirt prevents terminal movement axially in one direction.

As shown in FIG. 6, the plate 22 projects out of the recess 38 beyond the platform 32, with the slit 26 aligned with the exterior surface of the platform. The plate is then bent over, using the exterior surface of the platform to provide a sharp crease and fold in the plate in alignment with the slit. The plate then, covers the recess section 38A, overlies against the platform exterior surface and prevents movement of the terminal axially in a second direction, opposite the first direction. The lip 30 will register in the passageway section 38A. A self tapping screw 51 is threadably driven into the opening 28 and threadably secured internally of the surrounding lip 30. The side margins of the plate 22 interfit with the slotted portions of the T-shaped recess section 38A, and, the ears interfit with the slotted portions of recess 46, to prevent rotation of the barrel in respect to the housing 2. The ears are in a different plane than the plate portion in the recess portion 38A. Rotation is restrained thereby in different planes of support, at different radius distances from the axis of the barrel 6.

FIGS. 1, 2 and 7 illustrate a pair of insulated wire conductors 52, 54 inserted tranversely of their lengths into and along the barrel seam, and into the open end of the slot 42 and therealong. The jaws of the barrel slice through insulation on the conductors and resiliently engage and grip opposite sides of the wire portions of the conductors to establish electrical connections. The skirt 18 provides an enlarged circumferential support resisting the forces caused by wire insertion. The flanges 40 grip opposite sides of the insulated conductors to anchor the conductors to the housing 2. Another insulated wire conductor 56 is secured to an electrical contact 58 by cold forging. The contact is secured under the threaded screw 51.

Although one or more preferred embodiments of the present invention are disclosed, other embodiments and modifications thereof which would be apparent to one having ordinary skill are intended to be covered by the spirit and scope of the appended claims.

What is claimed is:

1. In a terminal block for commoning electricl wires or for providing a junction for plural conductors, and provided with an electrical terminal, having a hollow cylindrical barrel provided with a longitudinal open seam defining one or more sets of conductor engaging and gripping jaws, and a plate portion to receive a screw, and one or more projecting ears interfitting with said housing to prevent rotation of said barrel, the improvement comprising:

a portion of said plate interfitting in a slotted portion of said housig and spaced radially from said barrel a distance different than the radial spacing of each said ear from said barrel, an end of said barrel being radially outwardly flared and abutting a shoulder of said housing, and an opposite end of said barrel including a conductor receiving entry for said seam.

2. The improvement as recited in claim 1, and further including:

said plate including a slit aligned with an exterior surface of said housing, and said plate being sharply folded along said slit and bent over to overlie against said exterior surface.

3. The improvement as recited in claim 1, wherein each said ear is integral with a stem projecting outwardly from said barrel and inclined relative to the axis of said barrel.

4. A method of assembling a barrel terminal in a terminal block, comprising the steps of:

inserting a plate of the terminal along a passageway of said housing until said barrel is within said passageway and stopped against a shoulder of said housing, sharply creasing and folding a portion of the plate over an exterior surface of said housing to overlie said plate portion against said exterior surface an to cover said passageway.

5. The method as recited in claim 4, and further including the steps of:

retaining another portion of said plate in said passageway to prevent rotation of said barrel, and retaining ear portions of said terminal in said passageway to prevent rotation of said barrel.

* * * * *